US008984791B1

(12) United States Patent
Leslie

(10) Patent No.: US 8,984,791 B1
(45) Date of Patent: Mar. 24, 2015

(54) ADJUSTABLE GUN STOCK ASSEMBLY WITH MODULAR ACCESSORIES

(71) Applicant: Jimi Leslie, San Diego, CA (US)

(72) Inventor: Jimi Leslie, San Diego, CA (US)

( * ) Notice: Subject to any disclaimer, the term of this patent is extended or adjusted under 35 U.S.C. 154(b) by 0 days.

(21) Appl. No.: 14/323,746

(22) Filed: Jul. 3, 2014

Related U.S. Application Data

(60) Provisional application No. 61/925,047, filed on Jan. 8, 2014.

(51) Int. Cl.
*F41C 23/14* (2006.01)
*F41C 23/04* (2006.01)

(52) U.S. Cl.
CPC ..... *F41C 23/04* (2013.01)
USPC ..... 42/73; 42/71.01; 42/75.03

(58) Field of Classification Search
USPC ..... 42/71.01–75.01, 75.03
See application file for complete search history.

(56) References Cited

U.S. PATENT DOCUMENTS

| | | | | | |
|---|---|---|---|---|---|
| 2,484,168 | A * | 10/1949 | Jachimiec | 42/71.01 |
| 3,137,958 | A * | 6/1964 | Lewis et al. | 42/73 |
| 4,361,326 | A * | 11/1982 | Kokes | 473/206 |
| 4,964,232 | A * | 10/1990 | Mainland et al. | 42/44 |
| 5,173,564 | A * | 12/1992 | Hammond, Jr. | 42/75.03 |
| 6,517,133 | B2 * | 2/2003 | Seegmiller et al. | 294/139 |
| 6,543,172 | B1 * | 4/2003 | Armstrong | 42/71.01 |
| 6,641,277 | B2 * | 11/2003 | Smith | 362/111 |
| 6,651,371 | B2 * | 11/2003 | Fitzpatrick et al. | 42/72 |
| 6,779,289 | B2 * | 8/2004 | Kay | 42/75.03 |
| 6,925,744 | B2 * | 8/2005 | Kincel | 42/71.01 |
| 7,162,822 | B1 * | 1/2007 | Heayn et al. | 42/73 |
| 7,398,616 | B1 | 7/2008 | Weir | |
| 7,762,018 | B1 * | 7/2010 | Fitzpatrick et al. | 42/73 |
| 7,937,873 | B2 * | 5/2011 | Keng | 42/71.01 |
| 7,984,580 | B1 * | 7/2011 | Giauque et al. | 42/73 |
| 8,051,593 | B2 * | 11/2011 | Vesligai | 42/73 |
| 8,186,090 | B1 * | 5/2012 | Chiarolanza et al. | 42/73 |
| D661,366 | S * | 6/2012 | Zusman | D22/108 |
| D664,233 | S * | 7/2012 | Heidkamp et al. | D22/108 |
| 8,341,868 | B2 * | 1/2013 | Zusman | 42/73 |
| 8,381,427 | B2 * | 2/2013 | Nill | 42/73 |
| 8,438,771 | B1 * | 5/2013 | Boone | 42/72 |
| 8,468,729 | B1 * | 6/2013 | Sylvester | 42/1.06 |
| D697,162 | S * | 1/2014 | Faifer | D22/108 |
| 8,640,373 | B2 * | 2/2014 | Burt | 42/85 |
| 8,701,848 | B2 * | 4/2014 | Tesner et al. | 188/379 |
| 8,763,295 | B2 * | 7/2014 | Trimble | 42/72 |
| 2002/0050088 | A1 * | 5/2002 | Sharp | 42/73 |
| 2003/0110675 | A1 * | 6/2003 | Garrett et al. | 42/85 |
| 2005/0115134 | A1 * | 6/2005 | Bond et al. | 42/74 |
| 2005/0115140 | A1 * | 6/2005 | Little | 42/118 |
| 2005/0262752 | A1 * | 12/2005 | Robinson et al. | 42/71.01 |
| 2009/0288324 | A1 * | 11/2009 | Peterson et al. | 42/75.03 |

* cited by examiner

*Primary Examiner* — Michael David
(74) *Attorney, Agent, or Firm* — Kevin Keener; Kevin Keener Associates P.C.

(57) ABSTRACT

The invention is directed toward a butt stock assembly for a firearm. The butt stock assembly comprises a front cap, a base, a center frame, a tube housing, a release lever, a locking pin, a rotation pin, and a spring. The center frame has a plurality of attachment holes. The attachment holes provide a means for attaching modular firearm components to the butt stock assembly. The release lever is attached to the center frame by the rotation pin. The release lever pivots about the rotation pin. The release lever engages the locking pin. The locking pin engages the spring. The center frame has a top edge, a front edge, a back edge, and a bottom edge. The front cap is removably secured to the front edge of the center frame. The base is removably secured to the back edge of the center frame.

20 Claims, 9 Drawing Sheets

ADJUSTABLE GUN STOCK ASSEMBLY WITH MODULAR ACCESSORIES

PRIORITY

This application claims the benefit of U.S. Provisional Application No. 61/925,047 filed on Jan. 8, 2014, which is hereby incorporated in its entirety.

TECHNICAL FIELD

The invention has pertains to assault rifles and more particularly to an expandable butt stock for an assault rifle.

BACKGROUND OF THE INVENTION

Assault rifles are well known in the art. The civilian version of a semiautomatic rifle is known as the AR15. The AR15 is manufactured in a standard size. This presents a problem because users are of different sizes. The size of the butt stock may be well sized for one user but may not work adequately for a smaller user or larger user. What is needed is an extendable butt stock which can be attached to an AR15 receiver.

Existing art has attempted to solve this problem. U.S. Pat. No. 7,398,616 teaches an extendable butt stock. This patent is limited in that it utilizes only a portion of the elongated receiver extension tube 110 to create adjustable positions for the butt stock. In addition, the patent does not teach a system which may be extended or shortened quickly and easily but requires additional time for a user to change the length of the butt stock. What is needed is an extendable butt stock which may be extended and shortened quickly and easily by a user, without the need for screws or the use of tooling by the user.

In addition, the prior art is limited in that the prior art teaches extendable butt stocks which are primarily entire structures and cannot be disassembled. This presents a limitation when a user desires to fully disassemble a weapon for cleaning. What is needed is an extendable butt stock which can be easily disassembled and reassembled for cleaning purposes. Furthermore, such a system provides the benefit in that if any part of the structure is damaged then the individual component may be replaced rather than replacing the entire extendable butt stock, as is required with the prior art.

Additionally, there are many components which can be utilized with an AR15. Components that can be used with an AR15 can include a picatinny rail, a spike pad for breaking glass, a standard sling mount, a quick disconnect sling mount, rubber base pads, an adjustable cheek rise, an adjustable, rear base extension, among other items. The use of components such as these are normally factory installed on AR15s or require an exordinate amount of time to attach to a standard AR15. What is needed is a quick and efficient method to attach components to an AR15 when needed or desired and a quick and efficient method to remove components when they are no longer required. Therefore, what is needed is an extendable gun stock which allows for the quick and efficient attachment or detachment of modular components.

SUMMARY OF THE INVENTION

The invention is directed toward a butt stock assembly for a firearm. The butt stock assembly comprises a front cap, a base, a center frame, a tube housing, a release lever, a locking pin, a rotation pin, and a spring. The center frame has a plurality of attachment holes. The attachment holes provide a means for attaching modular firearm components to the butt stock assembly. The release lever comprises a first end and a second end. The release lever is attached to the center frame by the rotation pin. The release lever pivots about the rotation pin. The first end of the release lever pivots in an opposite direction than the second end of the release lever. The release lever engages the locking pin. The locking pin engages the spring. When a user pushes on the first end of the release lever the second end of the release lever pulls the locking pin toward the center frame, compressing the spring. The center frame has a top edge, a front edge, a back edge, and a bottom edge. The front cap is removably secured to the front edge of the center frame. The base is removably secured to the back edge of the center frame.

In another embodiment of the invention the tube housing may be placed against the top edge of the center frame. In another embodiment of the invention the center frame may further comprise two side plates positioned on the upper edge of the center frame and integral to the center frame. In another embodiment of the invention the assembly may further comprise two side plates which are removably secured to the upper edge of the center frame. In another embodiment of the invention the center frame may have two attachment holes positioned on the rear end of the center frame which are three inches apart. In another embodiment of the invention the center frame may have two attachment holes positioned on the lower edge of the center frame which are 0.55 inches apart. In another embodiment of the invention the center frame may have two attachment holes positioned on the upper edge of the center frame which are 2.15 inches apart. In another embodiment of the invention the center frame may have two attachment holes positioned on the upper edge of the center frame which are 3.2 inches apart. In another embodiment of the invention the center frame may have two attachment holes positioned on the upper edge of the center frame which are 4.25 inches apart. In another embodiment of the invention the center frame may have two attachment holes positioned on the upper edge of the center frame which are 1.05 inches apart.

In another embodiment of the invention the center frame may have four attachment holes positioned on the upper edge of the center frame. In this embodiment the four attachment holes are positioned in a direct line with a foremost hole positioned toward the front end of the center frame. In this embodiment, one attachment hole is 2.15 inches away from the foremost hole, one attachment hole is 3.2 inches away from the foremost hole, and one attachment hole is 4.25 inches away from the foremost hole. In another embodiment of the invention the butt stock assembly may further comprise a plurality of fasteners. In this embodiment the fasteners attach modular firearm components to the attachment holes of the center frame.

In another embodiment of the invention the butt stock assembly may further comprise an elongated receiver extension tube. In this embodiment the elongated receiver extension tube is circular and has a first end and a second end. The first end has an external thread complimentary to an internal thread of a receiver of a firearm. When the first end of the elongated receiver extension tube is attached to the receiver of a firearm a user may place the butt stock assembly on the elongated receiver extension tube by placing the second end of the elongated receiver extension tube within the tube housing of the butt stock assembly. In another version of this embodiment the elongated receiver extension tube has a plurality of pin receiver holes. The plurality of pin receiver holes are positioned in a direct line longitudinally along the body of the elongated receiver extension tube.

In any embodiment of the invention the components of the butt stock assembly may be make out of aluminum. In any embodiment of the invention the butt stock assembly may further comprise a cheek pad. In any embodiment of the invention the butt stock assembly may further comprise a plurality of sling mounts.

The invention is also directed toward a firearm with an expandable butt stock. The butt stock is utilized for attaching a plurality of modular firearm components. The firearm comprises an elongated receiver extension tube, a butt stock assembly, and a plurality of fasteners. The elongated receiver extension tube is circular and has a first end and a second end. The first end has an external thread complimentary to an internal thread of a receiver of a firearm. When the first end of the elongated receiver extension tube is attached to the receiver of a firearm a user may place the butt stock assembly on the elongated receiver extension tube by placing the second end of the elongated receiver extension tube within the tube housing of the butt stock assembly. The elongated receiver extension tube has a plurality of pin receiver holes. The plurality of pin receiver holes are positioned in a direct line longitudinally along the body of the elongated receiver extension tube. The butt stock assembly comprises a front cap, a base, a center frame, a tube housing, a release lever, a locking pin, a rotation pin, and a spring. The center frame has a plurality of attachment holes. The attachment holes provide a means for attaching modular firearm components to the butt stock assembly. The release lever comprises a first end and a second end. The release lever is attached to the center frame by the rotation pin. The release lever pivots about the rotation pin. The first end of the release lever pivots in an opposite direction than the second end of the release lever. The release lever engages the locking pin. The locking pin engages the spring. When a user pushes on the first end of the release lever the second end of the release lever pulls the locking pin toward the center frame, compressing the spring. The center frame has a top edge, a front edge, a back edge, and a bottom edge. The front cap is removably secured to the front edge of the center frame. The base is removably secured to the back edge of the center frame. The center frame has a plurality of attachment holes that provide a means for attaching modular firearm components to the butt stock assembly. The center frame has two attachment holes positioned on the rear end of the center frame. The two attachment holes positioned on the rear end of the center frame are three inches apart. The center frame has two attachment holes positioned on the lower edge of the center frame 0.55 inches apart. The center frame has four attachment holes positioned on the upper edge of the center frame. The four attachment holes are positioned in a direct line with a foremost hole positioned toward the front end of the center frame. One attachment hole is 2.15 inches away from the foremost hole, one attachment hole is 3.2 inches away from the foremost hole, and one attachment hole is 4.25 inches away from the foremost hole. The fasteners attach modular firearm components to the attachment holes of the center frame.

DETAILED DESCRIPTION OF THE DRAWINGS

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Figure 1:
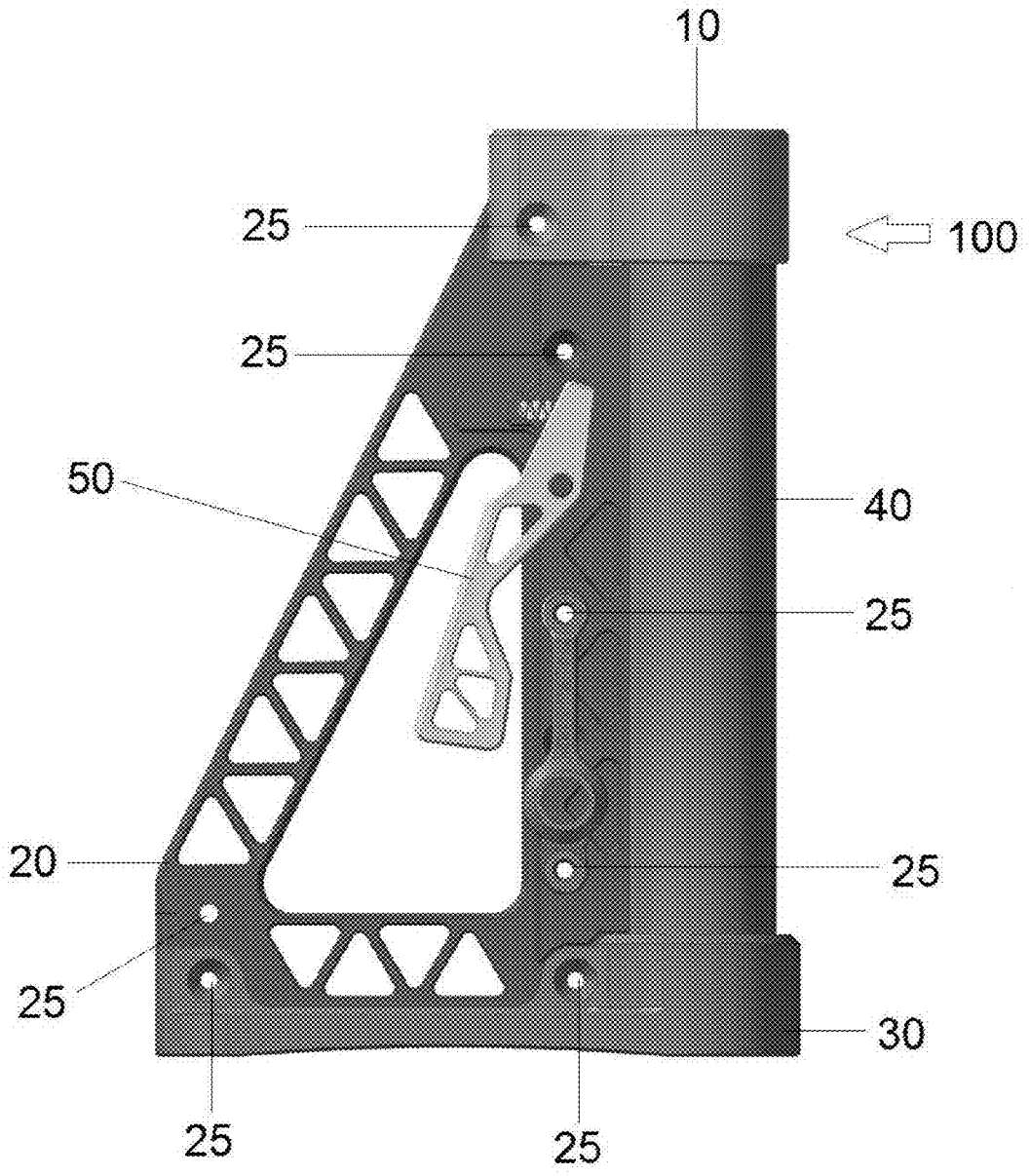
FIG. 1 is a side view of the gun stock assembly.

Referring to FIG. 1, the preferred embodiment of the butt stock assembly 100 is displayed. The butt stock assembly 100 is comprised primarily of a front cap 10, a center frame 20, a tube housing 40, a release lever 50, and a base 30. The center frame 20 is triangular in shape and preferably has a right angle. When positioned in the butt stock assembly 100, the right angle of the center frame 20 is positioned toward the top and the rear of the butt stock assembly 100. The center frame has a hollow triangular center and hollow triangular bracing along the angled portions of the center frame 20 to save expense and cost on material while providing a structurally sound product. The center frame 20 has a plurality of attachment holes 25 throughout the center frame 20. The attachment holes 25 permit the attachment of modular components to the butt stock assembly 100.

The attachment holes may be located in any position on the center frame 20. In the preferred embodiment the attachment holes 25 are located in specific, predesigned locations to permit efficient attachment and detachment of modular components. For instance, in the preferred embodiment, there are four attachment holes 25 along the top of the center frame 20. From the forward most hole the second hole is 2.15 inches away, the third hole is 3.2 inches away, and the fourth hole is 4.25 inches away. Additionally, there are two attachment holes 25 along the base edge of the center frame 20 which are 3 inches apart from each other. Additionally, there are two attachment holes 25 on the bottom of the center frame 20 which are 0.55 inches apart.

Figure 2:
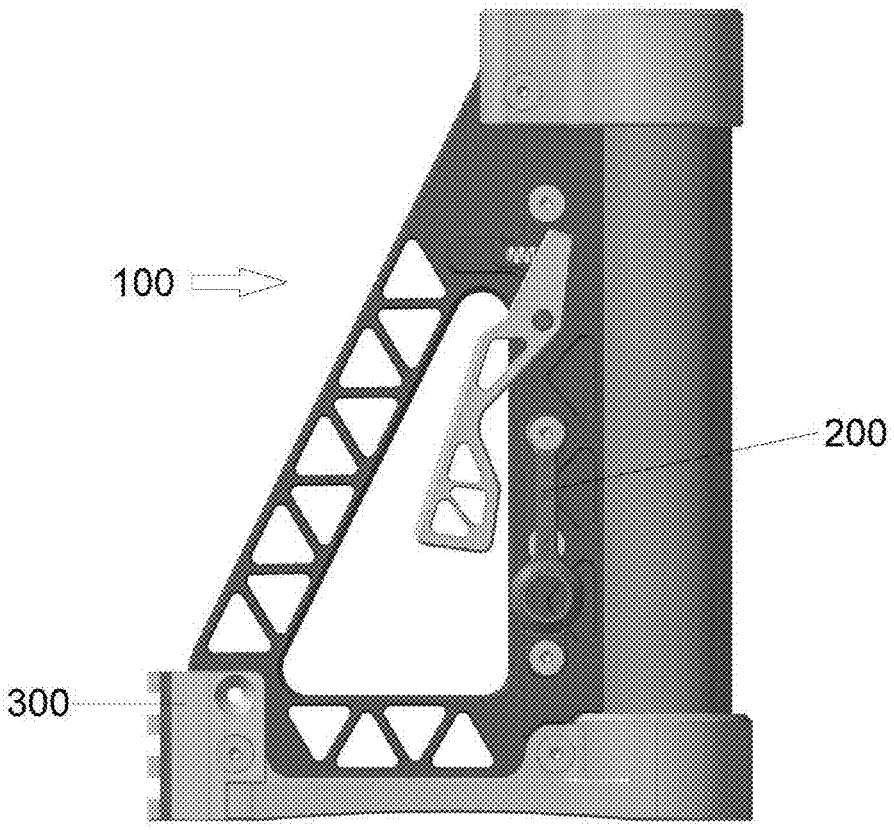
FIG. 2 is a side view of the gun stock assembly with modular components attached.
Figure 3:
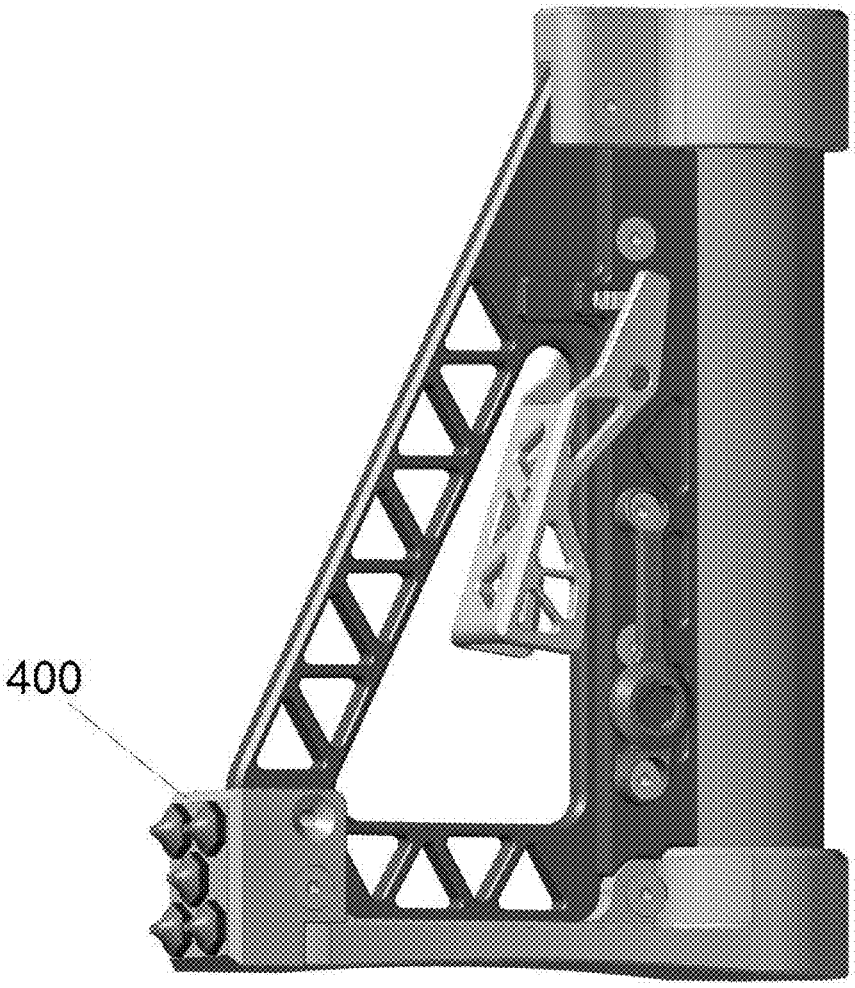
FIG. 3 is a perspective view of the gun stock assembly with a modular component attached.
Figure 4:
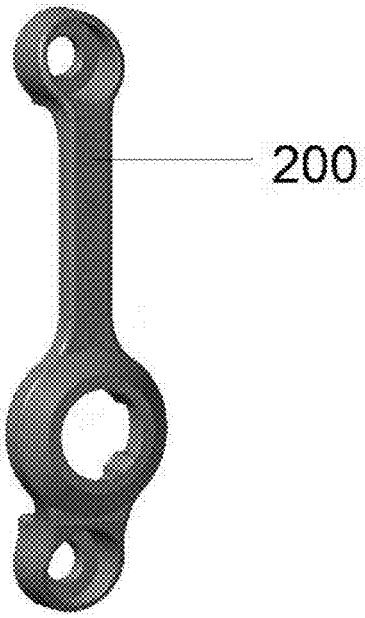
FIG. 4 is a view of a modular component.
Figure 5:
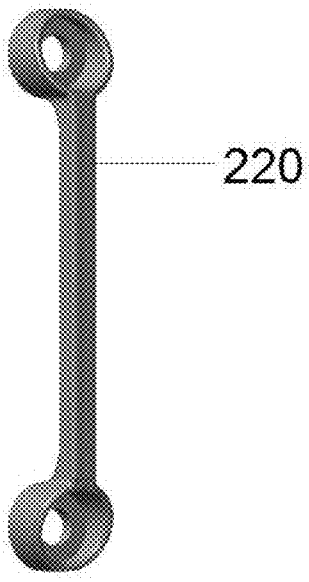
FIG. 5 is a view of a modular component.

Any number or type of modular components may be attached to the butt stock assembly 100. For instance, as displayed in FIG. 2, a picatinny rail modular component 300 is attached to the attachment holes 25 along the bottom of the center frame 20. In addition, there is a removable quick disconnect sling mount 200 attached to the attachment holes 25 along the top of the center frame 20. As shown in FIG. 3, a spike pad modular component 400 attached to the attachment holes 25 on the bottom of the center frame 20. The spike pad modular component 400 allows a user to break glass with the rear of the AR15. Such a component is desirable if the user is engaged in a police raid or the like. As shown in FIG. 4, the modular component attached to the butt stock assembly 100 may be a quick disconnect sling mount 200 which permits a user to quickly remove the gun from a shoulder strap. As shown in FIG. 5, the modular component may be a removable standard sling mount 220.

Figure 6:
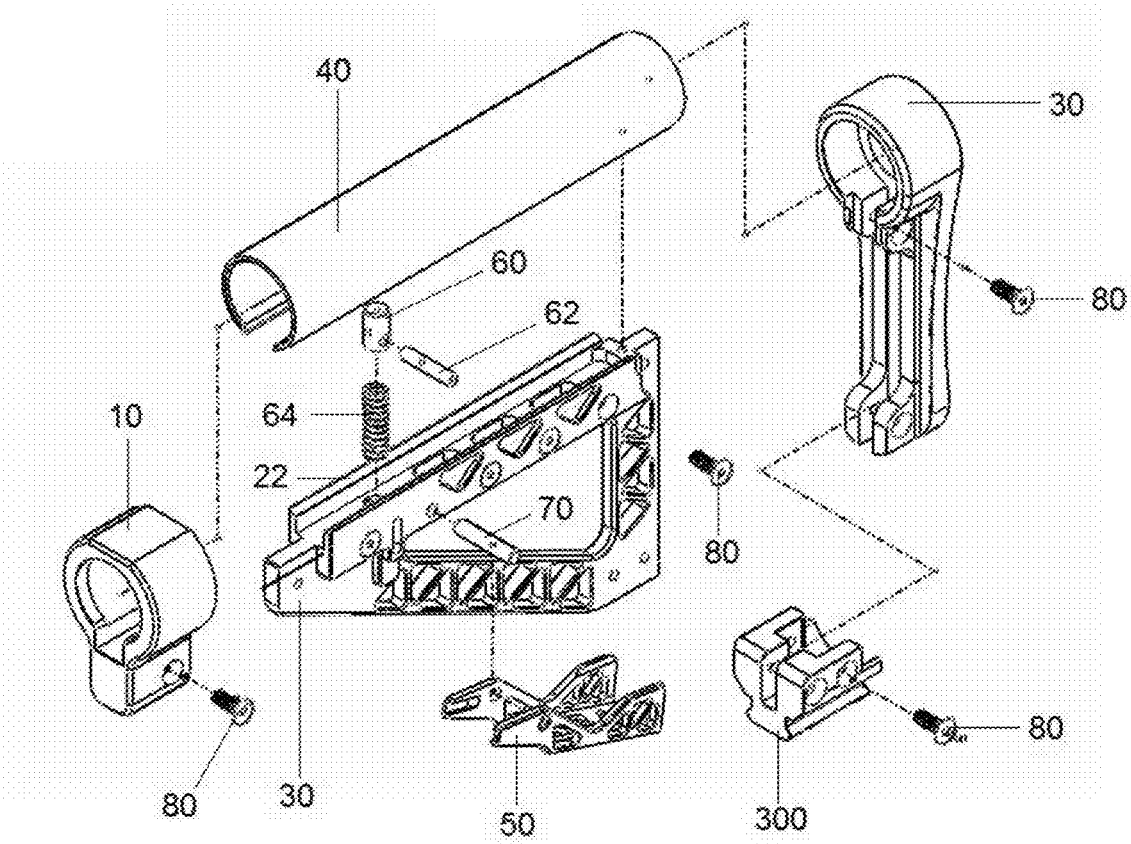
FIG. 6 is an exploded view of the gun stock assembly.

Referring to FIG. 6, an exploded view of the butt stock assembly 100 is displayed. The butt stock assembly 100 is comprised of a front cap 10, a center frame 20, a base 30, a tube housing 40, a release lever 50, a locking pin 60, and a rotation pin 70. The butt stock assembly is held together by a plurality of fasteners 80. The locking pin 60 has a cross bar 62 to create two horizontal arms. The horizontal arms of the locking pin 60 extend beyond the width of the center frame 20. The locking pin 60 fits within a spring 64. The center frame 20 has two side plates 22 extending upward. The tube housing 40 is attached to the top of the center frame on each side of the two side plates 22. The front cap 10 is structured to receive the front ends of the tube housing 40 and the center frame 20, including the two side plates 22 of the center frame. The front cap 10 is positioned over front end of the tube housing 40 and attached to the center frame 20 via a fastener 80. The base 30 is structured to receive the rear end of the tube housing 40 and the center frame 20, including the two side plates 22. The base 30 is positioned over the rear end of the tube housing 40 and secured to the center frame 20 via a fastener 80. The fasteners 80 may be any type of structural fastener able to be removed. Preferably the fasteners 80 are countersunk screws.

The release lever 50 attaches to the center frame 20 by means of the rotation pin 70. The rotation pin 70 passes through a hinge point located in the release lever 50. The rotation pin 70 is connected to center frame 20. In the preferred embodiment, the rotation pin attaches to the center frame 20 through the side plates 22. The release lever 50 has two ends extending from the hinge point, a long end and a short end. The short end of the release lever 50 has two arms which extend toward the front of the firearm. The arms of the release lever 50 extend over the horizontal arms of the locking pin 60. The long end of the release lever 50 has a press tab.

The top edge of the center frame 20 has a recess located approximately one quarter of the length from the front end of the rifle. The recess is of sufficient length and width to receive the locking pin 60. Interfacing between the locking pin 60 and the center frame 20 is a spring 64. As the locking pin 60 moves toward the center frame 20, the spring 64 is compressed. As the locking pin 60 moves away from the center frame 20, the spring 64 decompresses.

The tube housing 40 extends the length of the center frame 20. The tube housing 40 is substantially circular except that a void exists along the bottom side of the tube housing 40. The void runs along the length of the tube housing 40. When the tube housing 40 is attached to the center frame 20 a hollow internal cavity is formed.

Figure 7:
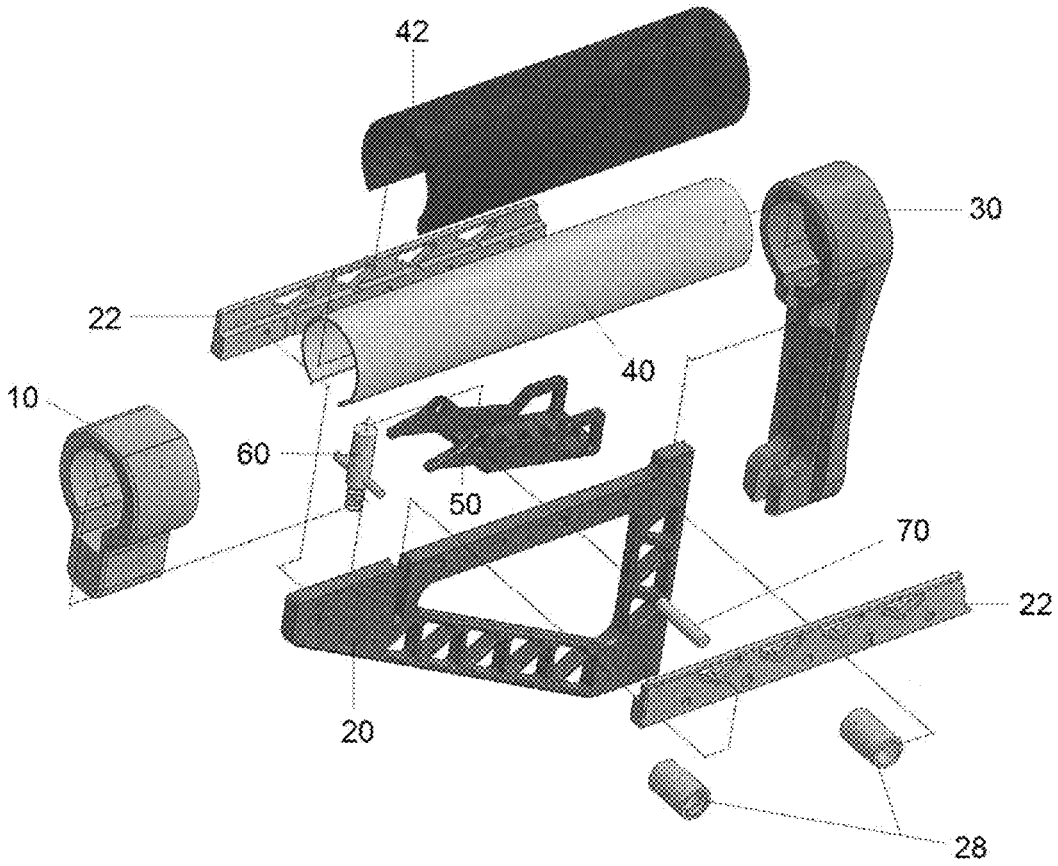
FIG. 7 is an exploded view of another embodiment of the gun stock assembly.

Referring to FIG. 7, an alternative embodiment of the butt stock assembly 100 is displayed. The alternative embodiment is comprised of a front cap 10, a center frame 20, a tube housing 40, two slide plates 22, a release lever 50, a cheek pad 42, a base 30, a locking pin 60, a rotation pin 70, and a plurality of sling mounts 28. In this embodiment, the two side plates 22 are separate and distinct from the center frame 20. The two side plates 22 align along the top edge of the center frame 20. The two side plates 22 are positioned along the sides of the top edge of the center frame 20 and with center frame 20 centered between the two side plates 22. The two side plates 22 are made up of a left side plate and a right side plate. Along the top edge of the center frame 20 are a plurality of holes extending through the thickness of the center frame 20. The plurality of holes match a plurality of holes located in the two side plates 22. The plurality of holes allow for a plurality of fasteners 80 to pass through the side plates 22, tieing the side plates 22 to the center frame 20.

On the inner edge of each of the two side plates 22, located approximately one quarter of the way back from the front edge of the two side plates 22 is a recessed groove. Each recessed groove is positioned to match the location of the recess in the center frame 20 which is structured to receive the locking pin 60. The locking pin 60 has two horizontal arms extending toward the sides. The horizontal arms of the locking pin 60 extend beyond the width of the center frame 20.

Attached to the front end of the butt stock assembly 100 is a front cap 10. The front cap 10 is structured to receive the front ends of the tube housing 40, the center frame 20, and the two side plates 22. The front cap 10 is attached to the center frame 20 by a fastener 80. Attached to the rear end of the butt stock assembly 100 is a base 30. The base 30 is structured to receive the rear end of the tube housing 40, the center frame 20, and the two side plates 22. The base 30 is attached to the center frame 20 by a fastener 80.

On the external surface of the tube housing 40 is placed a cheek pad 42. The cheek pad 42 is preferably constructed from a synthetic foam. The cheek pad 42 presents a soft surface to protect a user in the instance of recoil when the weapon is fired. Attached to one side of the center frame 20 are a plurality of sling mounts 28. Preferably there are two sling mounts 28. The sling mounts 28 allow an individual to attach a sling to the firearm.

Figure 8:
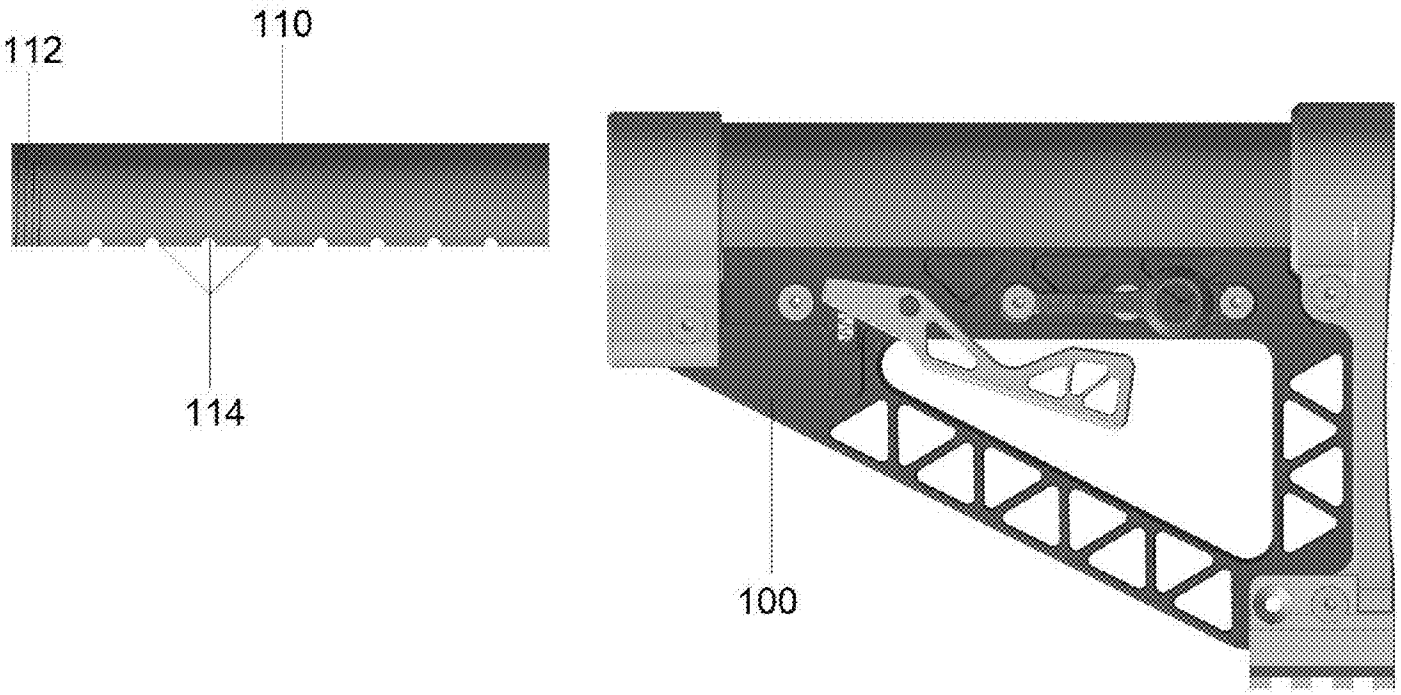
FIG. 8 is a side view of the gun stock assembly.

FIG. 8 displays the butt stock assembly 100 with the elongated receiver extension tube 110. The elongated receiver extension tube 110 has two ends. The first end has an external thread 112 complementary to an internal thread of a receiver for receiving a butt stock. When threaded into a receiver, the elongated receiver extension tube 110 extends outward from the rear of the receiver. The elongated receiver extension tube 110 has a plurality of pin receiver holes 114 extending along the lower side of the tube. When the elongated receiver extension tube 110 is completely threaded and mated to the receiver, the plurality of pin receiver holes 114 extends in a line located centrally along the center line of the tube. The plurality of pin receiver holes 114 may be in any number and may run partially along the length of the elongated receiver extension tube 110 or may run the entire length of the elongated receiver extension tube 110. Preferably, each pin receiver hole 114 along the lower side of the tube is uniform in size. Each pin receiver hole 114 is of a size sufficient to receive the locking pin 60 located on the butt stock assembly 100. In another embodiment of the invention each pin receiver hole 114 may not be a hole, but instead may be a depression into the elongated receiver extension tube 110 sufficient to receive the locking pin 60 such that when the locking pin 60 engages the depression, the butt stock assembly 100 is secured onto the elongated extension tube 110 and does not slide or move.

Figure 9:
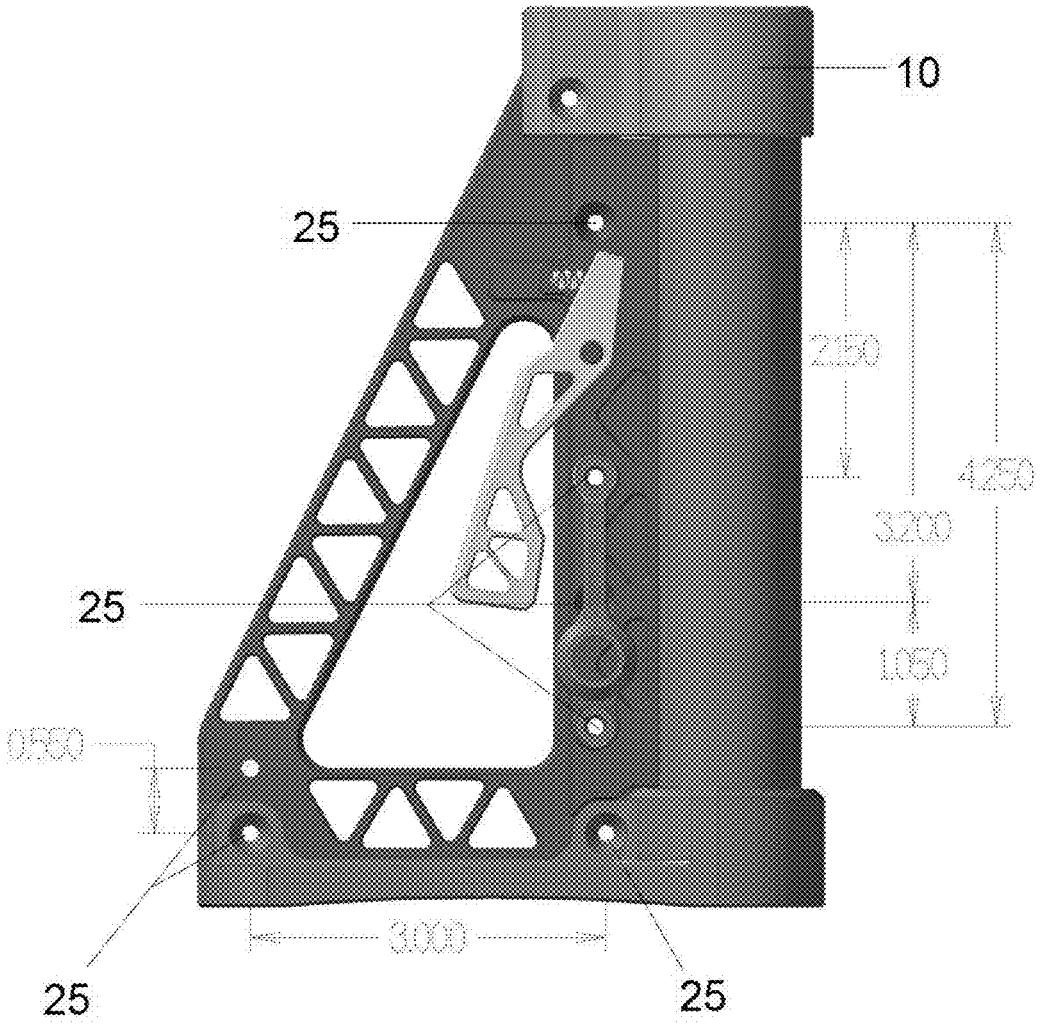
FIG. 9 is a side view of the gun stock assembly.

FIG. 9 displays the location of a plurality of attachment holes 25 in the preferred embodiment. The plurality of attachment holes 25 may be located in any position and location on the center frame 20. In the preferred embodiment there are four attachment holes 25 in a direct line along the top edge of the center frame 20. The foremost attachment hole 25 is closest to the front cap 10. One attachment hole is 2.15 inches from the foremost attachment hole 25. One attachment hole 25 is 3.2 inches from the foremost attachment hole 25. One attachment hole 25 is 4.25 inches from the foremost attachment hole 25. In the preferred embodiment there are two attachment holes 25 located at the rear edge of the center frame 20 that are three inches apart. In the preferred embodiment there are two attachment holes 25 located at the lower edge of the center frame 20 that are 0.55 inches apart.

The butt stock assembly 100 is structured to internally receive the elongated receiver extension tube 110. The butt stock assembly 100 secures to the elongated receiver extension tube 110 in a plurality of locations. In this manner the butt stock assembly 100 may be secured in the forward position on the elongated receiver extension tube 110 or secured in the rear position on the elongated receiver extension tube 110. When the butt stock assembly 100 is placed in the forward position, the total length of the firearm is shorter than when the butt stock assembly 100 is placed in the rear position. Individuals who are smaller in frame and stature would be able to utilize the firearm when the butt stock assembly 100 is positioned in the forward position. Individuals who are larger in frame and stature would be able to utilize the same firearm after positioning the butt stock assembly 100 in the rear position.

The components of the butt stock assembly 100 may be composed of any type of material. Preferably the components of the butt stock assembly 100 are composed of aluminum.

To utilize the butt stock assembly 100 a user removes the factory installed butt stock from a receiver. The user then threads on the elongated receiver extension tube 110 onto the receiver. The user then places the butt stock assembly 100 onto the elongated receiver extension tube 110. The elongated receiver extension tube 110 fits within the tube housing 40. The spring 64 attached to the locking pin 60 pushes the locking pin 60 upward and through the corresponding pin receiver hole 114 in the elongated receiver extension tube 110. The locking pin 60 thus locks the butt stock assembly 100 in place on the firearm. To move the butt stock assembly 100 along the length of the elongated receiver extension tube 110 a user pushes the press tab on the long end of the release lever 50. The release lever 50 then hinges around the hinge point such that pushing the press tab upward causes the short end of the release lever 50 to move downward. The two arms on the short end of the release lever 50 push downward on the horizontal arms of the locking pin 60. This downward pressure pushes the locking pin 60 down into the center frame 20 and compresses the spring 64 attached to the locking pin 60. This downward motion also removes the locking pin 60 from the corresponding pin receiver hole 114 in the elongated receiver extension tube 110. The butt stock assembly 100 may then slide forward or backward on the elongated receiver extension tube 110 until the locking pin 60 lines up with a selected corresponding hole in the elongated receiver extension tube 110 to create the desired total length of the firearm. The user then removes pressure from the press tab on the release lever 50. The spring 64 attached to the locking pin 60 then decompresses and pushes the locking pin 60 through the corresponding hole in the elongated receiver extension tube 110.

To disassemble and reassemble the butt stock assembly 100 a user removes the fasteners 80 from the front cap 10 and the base 30. The base 30 and front cap 10 may then be removed from the butt stock assembly 100. Afterward, if the center frame 20 and side plates 22 are separate, the center frame 20 and side plates 22 may be removed from each other and the tube housing 40. Additional fasteners 80 may need to be removed from the side plates 22 to detach the side plates 22 from the center frame 20. Any of the components of the butt stock assembly 100 may be replaced while the butt stock assembly 100 is disassembled. While disassembled, a user may clean and oil the components to prolong the useful life cycle of the butt stock assembly 100. The user may then put the butt stock assembly 100 back together by putting the center frame 20 and tube housing 40 back together (attaching the side frames 22 to the center frame 20 first if they are separate), positioning the front cap 10 and base 30 over the tube housing 40 and center frame 20, and secure all pieces together with the fasteners 80.

The user may also easily remove and detach modular components to the butt stock assembly 100 as needed or wanted. The modular components may be attached to the butt stock assembly 100 to change the functionality of the butt stock assembly 100. For instance, modular components such as the picatinny rail 300 or spike pad 400 allow a user to use the butt stock assembly 100 for another purpose. Alternatively, modular components may be attached to the butt stock assembly 100 simply for the purposes of carrying the modular component. The specific modular component may then be used on another location of the firearm when desired. For instance, a bipod or a scope could be attached to the butt stock assembly 100 and attached to the front or top of the firearm when the user desires. When the user is finished using the modular component the user may then reattach the modular component to the butt stock assembly 100.

The invention claimed is:

1. A butt stock assembly for a firearm comprising
- a. A front cap
- b. A base
- c. A center frame
  - i. Wherein said center frame has a plurality of attachment holes
  - ii. Wherein said attachment holes provide a means for attaching modular firearm components to the butt stock assembly
- d. A tube housing
- e. A release lever
  - i. Said release lever comprising a first end and a second end
- f. A locking pin
- g. A rotation pin
- h. A spring
- i. Wherein said release lever is attached to said center frame by said rotation pin
- j. Wherein said release lever pivots about said rotation pin
  - i. Wherein said first end of said release lever pivots in an opposite direction than said second end of said release lever
- k. Wherein said release lever engages said locking pin
- l. Wherein said locking pin engages said spring
- m. Wherein when a user pushes on said first end of said release lever said second end of said release lever pulls said locking pin toward said center frame, compressing said spring
- n. Wherein said center frame has a top edge, a front edge, a back edge, and a bottom edge
- o. Wherein said front cap is removably secured to said front edge of said center frame
- p. Wherein said base is removably secured to said back edge of said center frame.

2. The butt stock assembly as in claim 1
- a. Wherein said tube housing is placed against said top edge of said center frame.

3. The butt stock assembly as in claim 1
- a. Wherein said center frame further comprises two side plates positioned on said top edge of said center frame and integral to said center frame.

4. The butt stock assembly as in claim 1 further comprising
- a. Two side plates wherein said side plates are removably secured to said top edge of said center frame.

5. The butt stock assembly as in claim 1
- a. Wherein said center frame has two attachment holes positioned on a rear end of said center frame
- b. Wherein said two attachment holes positioned on the rear end of said center frame are three inches apart.

6. The butt stock assembly as in claim 1
- a. Wherein said center frame has two attachment holes positioned on the bottom edge of said center frame
- b. Wherein said attachment holes positioned on the bottom edge of said center frame are 0.55 inches apart.

7. The butt stock assembly as in claim 1
- a. Wherein said center frame has two attachment holes positioned on the top edge of said center frame
- b. Wherein said two attachment holes are 2.15 inches apart.

8. The butt stock assembly as in claim 1
a. Wherein said center frame has two attachment holes positioned on the top edge of said center frame
b. Wherein said two attachment holes are 3.2 inches apart.

9. The butt stock assembly as in claim 1
a. Wherein said center frame has two attachment holes positioned on the top edge of said center frame
b. Wherein said two attachment holes are 4.25 inches apart.

10. The butt stock assembly as in claim 1
a. Wherein said center frame has two attachment holes positioned on the top edge of said center frame
b. Wherein said two attachment holes are 1.05 inches apart.

11. The butt stock assembly as in claim 1
a. Wherein said center frame has four attachment holes positioned on the top edge of said center frame
b. Wherein said four attachment holes are positioned in a direct line with a foremost hole positioned toward a front end of the center frame
c. Wherein one attachment hole is 2.15 inches away from the foremost hole
d. Wherein one attachment hole is 3.2 inches away from the foremost hole
e. Wherein one attachment hole is 4.25 inches away from the foremost hole.

12. The butt stock assembly as in claim 1 further comprising
a. A plurality of fasteners
b. Wherein said fasteners attach modular firearm components to said attachment holes of said center frame.

13. The butt stock assembly as in claim 1 further comprising
a. An elongated receiver extension tube
i. Said elongated receiver extension tube being circular and having a first end and a second end, said first end having an external thread complimentary to an internal thread of a receiver of a firearm
b. Wherein when said first end of said elongated receiver extension tube is attached to the receiver of a firearm a user may place said butt stock assembly on said elongated receiver extension tube by placing said second end of said elongated receiver extension tube within said tube housing of said butt stock assembly.

14. The butt stock assembly as in claim 13
a. Wherein said elongated receiver extension tube has a plurality of pin receiver holes
b. Wherein said plurality of pin receiver holes are positioned in a direct line longitudinally along the body of said elongated receiver extension tube.

15. The butt stock assembly as in claim 1
a. Wherein the components of said butt stock assembly are made of aluminum.

16. The butt stock assembly as in claim 2
a. Wherein said center frame further comprises two side plates positioned on said top edge of said center frame and integral to said center frame
b. Wherein said center frame has two attachment holes positioned on a rear end of said center frame
i. Wherein said two attachment holes positioned on the rear end of said center frame are three inches apart
c. Wherein said center frame has two attachment holes positioned on the bottom edge of said center frame
i. Wherein said attachment holes positioned on the bottom edge of said center frame are 0.55 inches apart
d. Wherein said center frame has four attachment holes positioned on the top edge of said center frame
i. Wherein said four attachment holes are positioned in a direct line with a foremost hole positioned toward a front end of the center frame
ii. Wherein one attachment hole is 2.15 inches away from the foremost hole
iii. Wherein one attachment hole is 3.2 inches away from the foremost hole
iv. Wherein one attachment hole is 4.25 inches away from the foremost hole
e. A plurality of fasteners
i. Wherein said fasteners attach modular firearm components to said attachment holes of said center frame.

17. The butt stock assembly as in claim 16 further comprising
a. A cheek pad
b. A plurality of sling mounts.

18. The butt stock assembly as in claim 2 further comprising
a. Two side plates wherein said side plates are removably secured to said top edge of said center frame
b. Wherein said center frame has two attachment holes positioned on the rear end of said center frame
i. Wherein said two attachment holes positioned on the rear end of said center frame are three inches apart
c. Wherein said center frame has two attachment holes positioned on the bottom edge of said center frame
i. Wherein said attachment holes positioned on the bottom edge of said center frame are 0.55 inches apart
d. Wherein said center frame has four attachment holes positioned on the top edge of said center frame
i. Wherein said four attachment holes are positioned in a direct line with a foremost hole positioned toward a front end of the center frame
ii. Wherein one attachment hole is 2.15 inches away from the foremost hole
iii. Wherein one attachment hole is 3.2 inches away from the foremost hole
iv. Wherein one attachment hole is 4.25 inches away from the foremost hole
e. A plurality of fasteners
f. Wherein said fasteners attach modular firearm components to said attachment holes of said center frame.

19. The butt stock assembly as in claim 18 further comprising
a. A cheek pad
b. A plurality of sling mounts.

20. A firearm with an expandable butt stock, said butt stock utilized for attaching a plurality of modular firearm components, said firearm comprising
a. an elongated receiver extension tube, said elongated receiver extension tube being circular and having a first end and a second end, said first end having an external thread complementary to an internal thread of a receiver; said elongated receiver extension tube having a plurality of pin receiver holes extending along the lower side of the elongated receiver extension tube wherein said plurality of pin receiver holes are positioned in a direct line longitudinally along the body of said elongated receiver extension tube
b. a butt stock assembly, said butt stock assembly comprising
i. A front cap
ii. A base
iii. A center frame
1. Wherein said center frame has a top edge, a front edge, a back edge, and a bottom edge 2. Wherein said center frame has a plurality of attachment holes
3. Wherein said attachment holes provide a means for attaching modular firearm components to the butt stock assembly
4. Wherein said center frame has two attachment holes positioned on a rear end of said center frame
5. Wherein said two attachment holes positioned on the rear end of said center frame are three inches apart
6. Wherein said center frame has two attachment holes positioned on the bottom edge of said center frame
7. Wherein said attachment holes positioned on the bottom edge of said center frame are 0.55 inches apart
8. Wherein said center frame has four attachment holes positioned on the top edge of said center frame
9. Wherein said four attachment holes are positioned in a direct line with a foremost hole positioned toward a front end of the center frame
10. Wherein one attachment hole is 2.15 inches away from the foremost hole
11. Wherein one attachment hole is 3.2 inches away from the foremost hole
12. Wherein one attachment hole is 4.25 inches away from the foremost hole iv. A tube housing
v. A release lever
  1. Said release lever comprising a first end and a second end
vi. A locking pin
vii. A rotation pin
viii. A spring
ix. Wherein said release lever is attached to said center frame by said rotation pin
x. Wherein said release lever pivots about said rotation pin
xi. Wherein said first end of said release lever pivots in an opposite direction than said second end of said release lever
xii. Wherein said release lever engages said locking pin
xiii. Wherein said locking pin engages said spring
xiv. Wherein when a user pushes on said first end of said release lever said second end of said release lever pulls said locking pin toward said center frame, compressing said spring
xv. Wherein said front cap is removably secured to said front edge of said center frame
xvi. Wherein said base is removably secured to said back edge of said center frame c. A plurality of fasteners
  i. Wherein said fasteners attach modular firearm components to said attachment holes of said center frame.

* * * * *